United States Patent [19]

Wood

[11] 4,018,370

[45] Apr. 19, 1977

[54] BACK PACK FRAME

[76] Inventor: Thomas E. Wood, 3863 42nd NE., Seattle, Wash. 98105

[22] Filed: June 20, 1975

[21] Appl. No.: 588,795

[52] U.S. Cl. ..... 224/25 A; 403/298

[51] Int. Cl.² ..... A45F 3/10

[58] Field of Search ..... 224/25 R, 25 A, 8 R; 403/298, 192, 233, 235

[56] References Cited

UNITED STATES PATENTS

| | | | |
|---|---|---|---|
| 1,025,759 | 5/1912 | McCluskey | 403/298 X |
| 3,000,656 | 9/1961 | Hollaender | 403/298 |
| 3,219,243 | 11/1965 | Mack | 224/25 A X |
| 3,734,366 | 5/1973 | Wood | 224/25 A |
| 3,851,980 | 12/1974 | Worth et al. | 403/298 X |
| 3,860,157 | 1/1975 | Richards et al. | 224/8 R |

FOREIGN PATENTS OR APPLICATIONS

| | | | |
|---|---|---|---|
| 1,265,349 | 12/1961 | France | 403/192 |
| 2,022,144 | 11/1971 | Germany | 403/298 |

*Primary Examiner*—Robert J. Spar
*Assistant Examiner*—Randolph A. Reese
*Attorney, Agent, or Firm*—Graybeal, Barnard & Uhlir

[57] ABSTRACT

A plastic tubular pack frame is disclosed employing a unitary main frame member and uniquel y constructed transverse support members including a pair of tee connectors interconnected by a tubular cross member. In one embodiment, a transverse support member is formed by heating a section of plastic tubing, placing the ends of the tubing on the pin portions of tee connectors and allowing tubing to cool and shrink onto the pins. The pin portions of the tee connectors include a series of circumferentially and axially extending ribs which engage the internal walls of the box ends of the cross member forming a connection normally fixed against axial disconnection and normally fixed against rotation but rotatable without fracture in response to above normal rotational torques.

8 Claims, 7 Drawing Figures

Fig. 2.
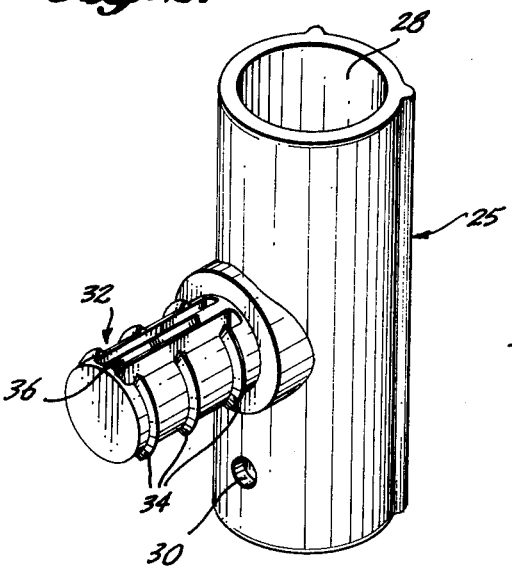
Fig. 3.
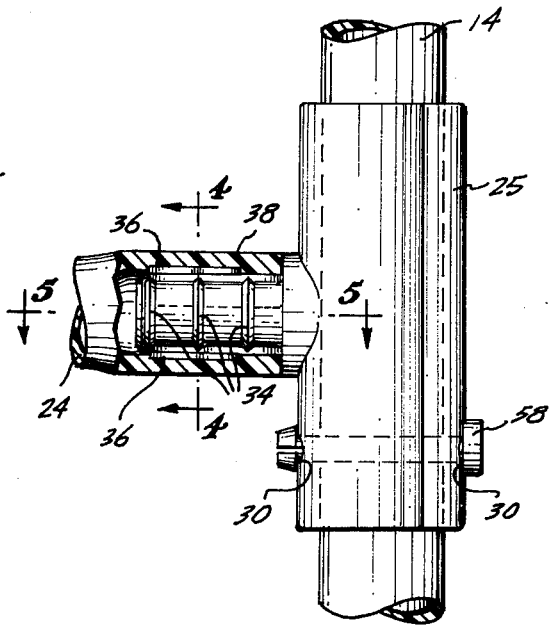
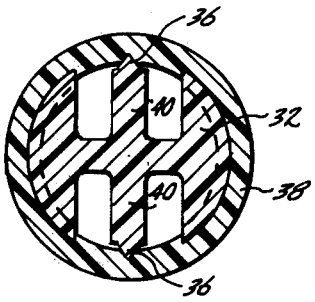
Fig. 4.
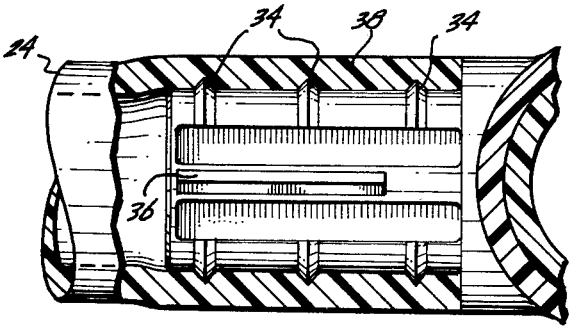
Fig. 5.

BACK PACK FRAME

BACKGROUND OF THE INVENTION

1. Field of the Invention

This invention relates in general to pack frames and in particular to pack frames formed of plastic tubing assembled in part by heat shrinking sections of tubing together whereby the frame members are fixedly but flexibly interconnected with each other at joints adapted to give without fracturing or disengaging under the application of above normal force thereto.

2. Description of the Prior Art

Prior pack frames constructed of polyvinyl chloride tubing normally involved gluing the frame members together by means of conventional setting glue or plastic cement. During the assembly of the pack frame members, a set or cure period for the glue was necessary when the members were initially interconnected. The bond thus formed between the frame members was relatively rigid and incapable of flexing without fracturing beyond the degree of flex inherent in the tubing material itself when subjected to stress such as that occurring when the pack frame was accidentally dropped with a loaded pack bag thereon. When repeatedly subjected to such stresses, as would normally occur during extended use in a recreational environment, the portions of the tubing forming the connections or joints between frame members sometimes developed hairline fractures which weakened and occasionally rendered the pack frame unserviceable.

My prior patent, U.S. Pat. No. 3,734,366 discloses a pack frame constructed from plastic tubing material including tee connectors slidably mounted on vertical frame members and glued to cross members.

U.S. Pat. No. 3,860,157 discloses a plastic tubing pack frame employing a stretchable netting extending between the upstanding parallel legs to hold the frame members in engagement with each other.

BRIEF SUMMARY OF THE INVENTION

In one embodiment of the present invention, a tee connector is employed having a tubular sleeve portion and a transverse pin portion, the pin portion including a series of circumferentially and axially extending ribs. A pack frame transverse support member is formed by inserting the pin portions of two tees into the box ends of a heated section of plastic tubing material. Upon cooling, contraction of the box end of the tubing material upon the pin portion of the tee forms a connection normally fixed against axial disconnection and normally fixed against rotation but rotatable in response to overriding rotational torque. Another section of tubing is heated and molded to form a substantially U-shaped frame member including a pair of upstanding parallel legs and a curved transverse bottom portion. In the final assembly of the pack frame, the tubular sleeve portions of the tee connectors attached to each end of the cross member are slipped over and adjustably fixed to the upstanding parallel legs.

A detachable end frame member may be interconnected to the pack frame by means of column connectors which include a first pin end portion releasably insertable into the box end of one of the upstanding parallel legs of the U-shaped frame member and an axially aligned opposed second pin end portion having a series of circumferentially extending ribs thereon for forming a fixed connection with the box end of the end frame member.

Various advantages of the present invention will become apparent upon reading the following specification and referring to the accompanying drawings in which simple characters of reference represent corresponding parts of the several views.

BRIEF DESCRIPTION OF THE DRAWINGS

FIG. 2 is a perspective view of a typical tee connector constructed in accordance with the instant invention;

FIG. 3 is a partial sectional view of a tee connector engaging both one of the upstanding parallel legs of the pack frame and a cross member;

FIG. 4 is a sectional view taken along lines 4—4 of FIG. 3;

FIG. 5 is a partial sectional view taken along lines 5—5 of FIG. 3;

DETAILED DESCRIPTION OF THE INVENTION

Figure 1:
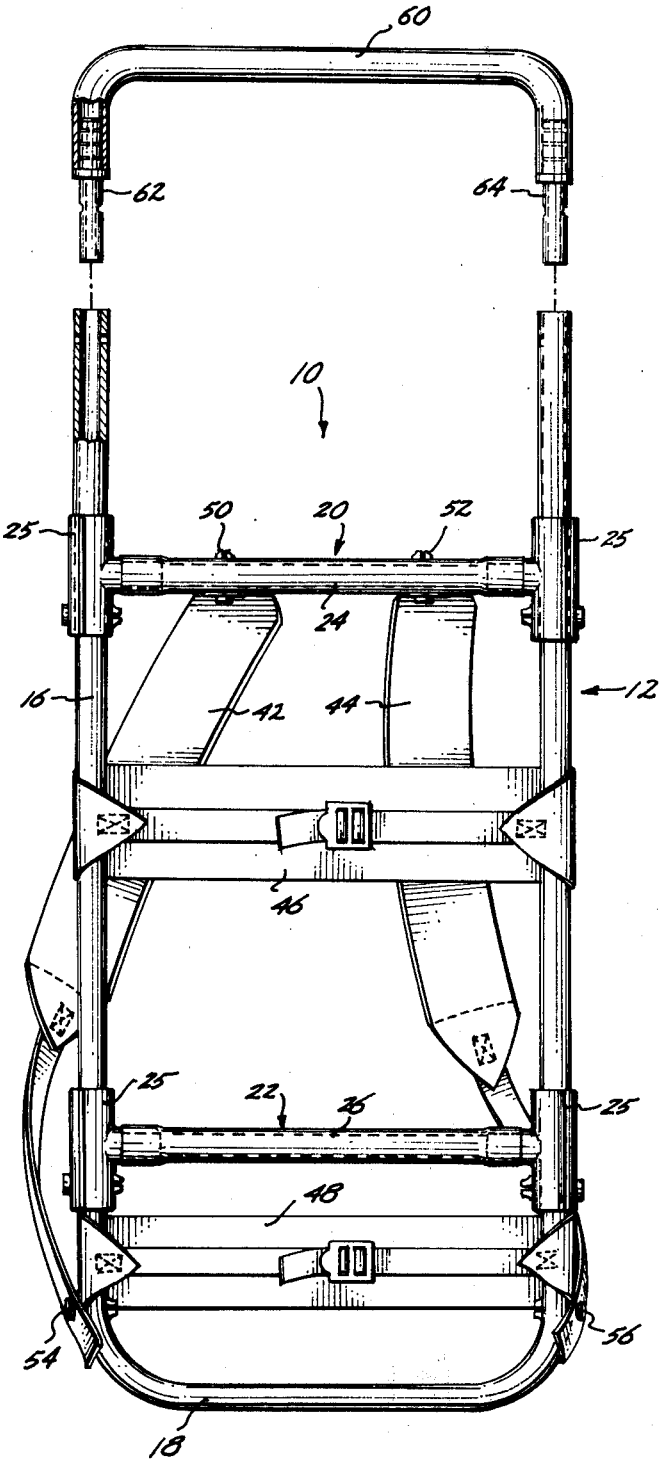
FIG. 1 is a partially exploded view of a typical pack frame constructed in accordance with the instant invention.

Referring to FIG. 1, a pack frame 10 is illustrated, comprising a main frame member 12 including a pair of upstanding parallel legs 14 and 16 and a transverse bottom portion 18, and transverse support members 20 and 22 comprising curved tubular cross members 24 and 26 which are slidably mounted on the upstanding parallel legs by means of like tee connectors 25. Referring to FIG. 2, tee connector 25 is disclosed having a tubular sleeve portion 28 with an internal diameter slightly larger than the external diameter of the upstanding parallel leg 14 with which it cooperates. The sleeve portion includes an aligned pair of holes 30 while the pin portion 32 of the tee connector includes a series of spaced circumferentially extending ribs 34 and a pair of axially extending ribs 36 for engaging the box end 38 of a tubular cross member such as 24. The pin portion 32 of the tee connector is best shown engaging the box end of a cross member in FIGS. 3, 4 and 5. Axially extending ribs 36 extend outwardly from a wall 40 formed in alignment with the outer line of pin 32, such that the ribs are raised above the surface of pin 32.

After engagement in a manner to be discussed more completely hereafter, the circumferentially extending ribs 34 and axially extending ribs 36 form mating indentations in the interior surface of the box end 38 of the cross member 24. Axial pull, tending to remove pin 32 from the box end of the cross member is resisted by circumferentially extending ribs 34 engaging the mating indents in the inner surface of the box end of the cross member.

In a similar fashion, rotational torque is resisted by axially extending ribs 36 engaging mating indents on the inner surface of the box end of the tubular cross frame member. Axially extending ribs 36 extend outwardly from pin 32 and engage indents of like depth in the box end of the cross frame member such that a relatively substantial torque must be applied to the connection to cause the members to rotate relative to each other. Normal rotational torques of the magnitude normally encountered during pack frame use are not sufficiently large to cause relative rotation of the pin and tubular cross member, but non-normal excess torques of a magnitude sufficient to crack or fracture glued connections of the type used in the past will simply cause the pin and cross frame member to rotate relative each other without structural damage to either member.

As a result, in part, of the curvature of the tubular cross frame member whereby the center portion of the member is outside the plane defined by the upstanding parallel legs of the main frame member such that a force on the central portion of the cross frame member is amplified with respect to its connection with pin 32 through a moment arm, and partially as a result of conventional pack frame construction whereby shoulder straps 42 and 44 are connected at their upper ends to one of the cross frame members, rotational torques are often encountered at the connection between pin 32 and the cross frame member 24. If an excessive rotational torque is applied to the connection between the pin and the cross frame member, the axially extending ribs 36 are designed to move out of the mating indentations in the box end inner surface and the cross frame member can rotate over the axially extending ribs 36 with the ribs in contact with the inner surface of the cross frame member thereby preventing damage to either the tee connector or the cross member. It will be understood that when the cross member is manually rotated back to its original position the ribs 36 will again engage the cooperating indents on the inner wall of the cross member so that the connection may again resist normal rotational torques.

As illustrated in FIG. 1, conventional pads 46 and 48 are positioned at the most likely points of contact between the wearer's back and the pack frame, which points may vary depending on the size of the wearer. Conventional shoulder straps 42 and 44 are mounted at one end on cross member 24 by means of pin mounts 50 and 52, respectively, and at their opposite end on upstanding parallel legs 16 and 14 by means of pin mounts 54 and 56, respectively.

Removable pin 58, also shown in FIG. 3, can be extracted to allow movement of the tee connector 25 along upstanding parallel leg 14 of the frame member. When the tee connector 25 has been moved to a new desired position along the upstanding parallel leg, removable pin 58 is re-inserted through holes 30 in sleeve 28 and through aligned holes provided in the upstanding leg 14. It should be understood that any number of sets of holes capable of alignment with the holes 30 in the tee connector can be drilled in the upstanding parallel legs, however it has been found that three sets of holes spaced one to two inches apart are normally sufficient to provide comfortable placement of the carrying straps for most users.

Figure 6:
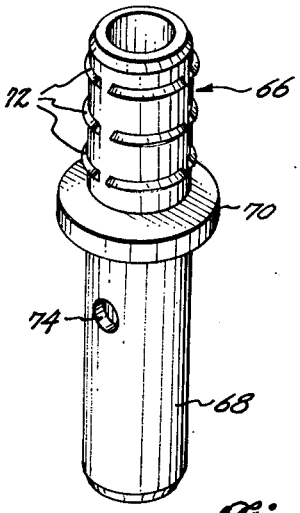
FIG. 6 is a perspective view of a typical column connector constructed in accordance with the instant invention.
Figure 7:
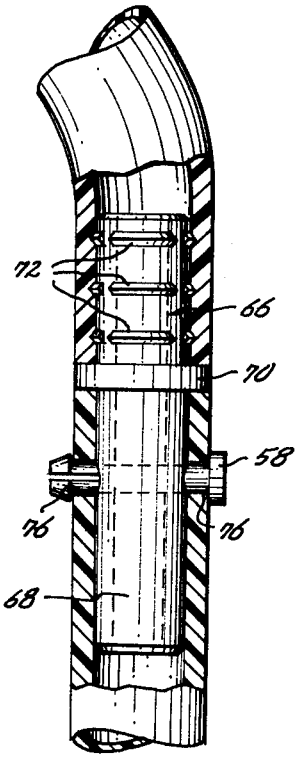
FIG. 7 is a partial sectional view illustrating a column connector engaging both an upstanding parallel leg of the pack frame and the detachable end frame member.

Referring again to FIG. 1, a detachable end frame member 60 is shown including two identical column connectors 62 and 64. A column connector such as 62 or 64 illustrated in greater detail in FIG. 6 may be molded from a plastic material and may include a first pin end 66, an opposed axially aligned second pin end 68 and a positioning flange 70 positioned therebetween. Pin end 66 includes a series of segmented circumferentially extending ribs 72 for engaging the inner surface of the box ends of the end frame member 60. The outer diameter of the second pin end 68 is less than the internal diameter of the box ends of the upstanding parallel legs 14 or 16 so that the second pin end can be easily inserted therein. Aligned holes 74 are provided in the walls of pin end 68, and as shown in FIG. 7 are adapted to receive a pin such as 58 which also extends through correspondingly aligned holes 76 in the box ends of the upstanding parallel legs to form a fixed connection between the end frame member 60 and the upstanding legs of the U-shaped frame member. The rigidity of frame member 12 is significantly increased by the interconnection of end frame member 60, such rigidity being particularly desirable if a heavy load is to be carried on the pack frame.

My heretofore mentioned patent more clearly illustrates one form of pin which may be used as the herein shown removable pins 58 as well as at the pin mounts 50, 52, 54, 56. Such a pin basically comprises a head portion and a split shank portion designed to prevent inadvertent or unintentional removal of the pin. It will be understood that such a pin may be satisfactorily molded from various plastic materials, including the tubing material from which the frame components themselves are molded.

In the construction of a typical pack frame according to the instant invention, a section of a room temperature polyvinyl chloride tubing of suitable length and internal diameter (approximately 76 centimeters and ⅝ inch diameter for a standard sized frame) is heated to a moldable condition such as by heating at a temperature of 250° F. for approximately 20 minutes. The temperatures and heating times may, of course, vary depending upon the nature of the tubing material selected and the times and temperatures listed herein have been found satisfactory for a polyvinyl chloride tubing having a specific gravity of approximately 1.5, a tensile strength of between 8,000 and 10,000 psi., an impact strength of about 15 ft-lbs/in. notch and a hardness of about 83 Shore *d.* The heated pliable tubing may then be placed in a jig mold and allowed to cool and harden to form the U-shaped main frame member 12. After cooling under the influence of a forced airstream, multiple pairs of aligned holes are drilled in upstanding parallel legs 14 and 16 adapted to receive the removable pins 58 described above.

Cross members such as 24 and 26 are formed by heating a section of like tubing of a shorter length selected to provide a desired curvature between the upstanding legs of frame member 12 to a limp pliable or moldable condition. The box ends of the pliable tubing are then reamed and slipped over the pin portions 32 of two tee connectors mounted in a jig. It should be understood, that the predetermined relative spacing of the tee connectors in the jig in conjunction with the length of the tubing selected for the cross member, determines the curvature of the cross member. As the tubing cools, indentations are formed on the internal surface of the box ends by contraction of the tubing against the circumferentially and axially extending ribs on the pin portion of the tee.

In a like manner, an end frame member 60 is formed by heating a selected length of the same tubing to a pliable condition, molding the pliable tubing in a jig, reaming the ends of the tubing to a size slightly larger than the pin end 66 of a column connector such as 62 or 64 and inserting the pin end 66 in the box end of the tubing. Positioning flange 70 limits and controls the depth of insertion of the pin into the box end of the tubing. Upon cooling, the tubing contracts on the circumferentially extending ribs 72 of the pin end 66 forming indentations on the internal surface of the box end of the end frame member which, in cooperation with the ribs 72, resist removal of the pin from the tubing. The end frame member 60 is then mounted on the upstanding parallel legs 14 and 16 and holes are drilled in both the upstanding parallel legs and the column connectors adapted to receive removable pins 58.

Final assembly of the pack frame can now be accomplished by removing the end frame member 60 and sliding the transverse support members 20 and 22 along the upstanding parallel legs 14 and 16. The holes 30 in the tubular sleeve portion 28 of a tee connector such as that shown in FIGS. 2 and 3, are aligned with corresponding holes in the legs 14 and 16 of the frame member so that pins may be inserted therethrough to fix the location of the transverse support members on the upstanding legs. End frame member 60 may, if desired, then be interconnected with the frame member by insertion of column connectors 62 and 64 into the box ends of the upstanding parallel legs 16 and 14 and introducing removable pins through the aligned holes.

The invention may be embodied in other specific forms without departing from the spirit or character thereof. The present embodiments are therefore to be considered in all respects as illustrative and not restrictive. The scope of the invention is indicated by the appended claims rather than by the foregoing description and all changes which come within the meaning and range of equivalency of the claims are embraced therein.

What is claimed is:

1. A back pack frame comprising:

a generally U-shaped tubular plastic main frame member including a curved transverse bottom portion and a pair of upstanding parallel legs, each of said legs including a plurality of vertically spaced pairs of aligned holes therein;

at least one transverse support member extending between said upstanding legs a distance above said curved transverse bottom portion;

said transverse support member comprising a pair of tee connectors each having a tubular sleeve portion engageable with one of said upstanding legs and a pin portion extending normally outward from said sleeve portion, and a tubular cross member interconnecting said tee connectors in a manner such that the box ends of said cross member engage the pin portions of said tee connectors;

the pin portions of said tee connectors each having a cylindrical surface including at least one axially extending raised rib and at least one circumferentially extending raised rib protruding radially outwardly therefrom, engaging the inner walls of the box ends of said cross member to fix said tee connectors and said cross member against axial disconnection or rotation under normal pack frame use conditions, said cross member being rotatable on said pin in response to above normal torque applied to said cross member and thereafter being manually rotatable to reform a connection fixed against rotation during normal pack frame use;

the tubular sleeve portions of said tee connectors including a pair of aligned holes positionable adjacent selected pairs of aligned holes on said upstanding parallel legs; and pin means extending through said aligned pairs of holes to hold said tee connector in fixed engagement with said upstanding parallel legs.

2. The back pack frame of claim 1 including a pair of vertically spaced transverse support members mounted on the upstanding parallel legs of said main frame member.

3. The back pack frame of claim 1 wherein said pin portions of each of said tee connectors includes at least two axially extending raised ribs and at least two circumferentially extending raised ribs.

4. The back pack frame of claim 1 wherein said axially extending and radially extending raised ribs on the pin portion of said tee connectors engage cooperating indents in the inner walls of the tubular cross member.

5. A back pack frame comprising:

a U-shaped tubular plastic main frame member including a curved bottom portion and a pair of upstanding parallel legs;

a transverse support member extending between said upstanding parallel legs including a tubular cross member having a pair of tee connectors mounted on each end;

said tee connectors each including a tubular sleeve portion engageable with said upstanding legs and a pin portion engageable with the ends of said tubular cross member;

said pin portion including at least one circumferentially extending and axially extending raised rib adapted to mate with cooperating indents on the inner walls of said tubular cross member to form a connection fixed against axial disengagement or rotation during normal pack frame use, said indents being rotatable out of engagement with said axially extending rib in response to above normal torque applied to said tubular cross member and thereafter being manually rotatable to re-engage said indents with said axially extending rib to reform a connection fixed against rotation during normal pack frame use.

6. The pack frame of claim 5 wherein said tubular cross member extending between said tee connectors is curved along its length such that the central portion thereof is outside the plane defined by said upstanding parallel legs.

7. The pack frame of claim 5 including a U-shaped end frame member extending between the upper ends of said upstanding parallel legs, said end frame member including a pair of double pin column connectors engaging and interconnecting said end frame member with said upstanding parallel legs.

8. The pack frame of claim 5 including a pair of shoulder straps mounted at their upper ends to said tubular cross member.

* * * * *

UNITED STATES PATENT OFFICE

CERTIFICATE OF CORRECTION

Patent No. 4,018,370 Dated April 19, 1977

Inventor(s) THOMAS E. WOOD

It is certified that error appears in the above-identified patent and that said Letters Patent are hereby corrected as shown below:

In the Abstract, line 2, change "uniquel y" to - - uniquely - -

In Column 2, line 49, change "outer" to - - center - -

Signed and Sealed this

*fifth* Day of *July 1977*

[SEAL]

*Attest:*

RUTH C. MASON
*Attesting Officer*

C. MARSHALL DANN
*Commissioner of Patents and Trademarks*